United States Patent [19]

Danguillier et al.

[11] 4,371,425

[45] Feb. 1, 1983

[54] SHAFT-LIKE DRY COOLER FOR COKE

[75] Inventors: Wilhelm Danguillier, Bochum; Wolfgang Grams, Herne; Jürgen Tietze, Bochum, all of Fed. Rep. of Germany

[73] Assignee: Dr. C. Otto & Comp. G.m.b.H., Bochum, Fed. Rep. of Germany

[21] Appl. No.: 255,231

[22] Filed: Apr. 17, 1981

[30] Foreign Application Priority Data

May 16, 1980 [DE] Fed. Rep. of Germany ..... 3018814

[51] Int. Cl.[3] ..... C10B 39/02

[52] U.S. Cl. ..... 202/228; 201/39; 34/170

[58] Field of Search ..... 202/228, 227; 201/39; 34/168–170

[56] References Cited

U.S. PATENT DOCUMENTS 1,481,873 1/1924 Moetteli ..... 202/228
1,496,094 6/1924 Moetteli ..... 202/228
1,545,060 7/1925 Moetteli ..... 202/228

FOREIGN PATENT DOCUMENTS 1061412 3/1967 United Kingdom ..... 202/228

*Primary Examiner*—Norman Yudkoff
*Attorney, Agent, or Firm*—Thomas H. Murray; Clifford A. Poff

[57] ABSTRACT

Coke is dry cooled in a shaft-like cooler by gases conveyed through the coke. The cooler comprises a top antechamber below a charging opening, a cooling chamber under the antechamber and having a gas inlet and a coke outlet at the bottom end. Between the antechamber and the cooling chamber, there is a cylindrical wall having a gas inlet. The cooling chamber is divided by radial walls which abut a central masonry core and divide the chamber into three shaft-like chambers to insure uniform descending of the coke. A prop is placed at the center of each component shaft for deflecting the descending coke from a central region. Cooling gas is supplied through a pipe having a downwardly-directed opening below a central masonry core. Additional cooling gas is supplied by an annular chamber surrounding a cone at a coke outlet of the cooling chamber.

5 Claims, 2 Drawing Figures

SHAFT-LIKE DRY COOLER FOR COKE

BACKGROUND OF THE INVENTION

Figure 1:
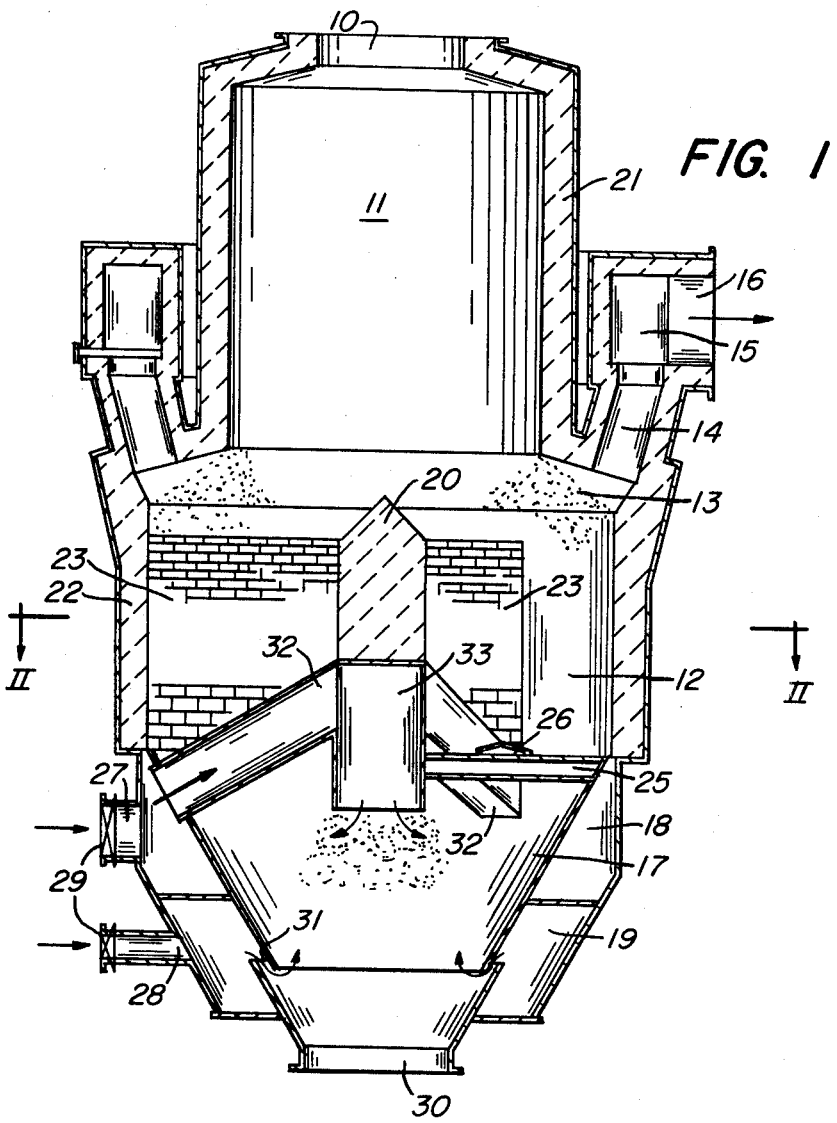

This invention relates to a shaft-like cooler wherein gases are conveyed through hot coke for cooling thereof. More particularly, the present invention relates to providing such a cooler having a top antechamber below a charging opening and below the antechamber there is a cooling chamber having a gas inlet and a coke outlet at the bottom thereof and a cylindrical wall between the antechamber and the cooling chamber having a gas outlet.

It is already known in the art that coke descends in a shaft-like container at varying speeds in different regions across the cross section of the container. The coke descends somewhat more slowly at the walls of the container and faster near the middle portion thereof. On the other hand, an upward stream of cooling gas is said to move faster at the walls of the container and slower at the middle portion of the container. The temperature isotherm to the body of coke across a longitudinal section of a vertical chamber takes the form of a parabola having an inverted apex.

For these reasons, it is known to construct and operate a shaft-like dry cooler for coke with a divider for the coke stream in the cooling chamber. A major part of the cooling gas is supplied from the top of the divider into the coke stream. In this way, the gas flows through the coke only partly in a countercurrent manner and partly in a cross-current manner.

SUMMARY OF THE INVENTION

It is an object of the present invention to construct a shaft-like cooler for uniformly cooling a relatively small volume of coke accumulating per unit of time in a cooling chamber.

According to the present invention, there is provided a shaft-like cooler for dry cooling of coke with gases conveyed through the coke wherein the cooler includes the combination of a top antechamber having a coke-charging opening in the top thereof, a cooling chamber below the top antechamber including an inlet for cooling gases and a coke outlet at the bottom end thereof, the cooling chamber further including generally vertical walls extending radially to divide the cooling chamber, and a cylindrical wall including a gas outlet between the antechamber and the cooling chamber.

The present invention is based upon the unexpected discovery that in a shaft-like cooler for dry cooling of coke, the consistent application of a countercurrent principle for guiding the coke and cooling gas will bring about the maximum amount of transmitted heat, i.e., work per shaft; whereas any deviation of the form to the transverse flow of gas will reduce the work per shaft. The heat exchange process between coke and cooling gases must be brought about with very small local temperature differences. The heated gases discharged from various regions to the shaft cross section should have substantially the same temperature.

To this end, according to the present invention, the speed at which the coke descends is made uniform over the entire cross section of the shaft-like cooler. In order to allow for tendency of the coke, as previously described, to freely fall more rapidly at the center of the cross section of the shaft than at the walls, the shaft within the cooling chamber is divided by vertical walls extending radially into component chambers or shafts having cross sections which are smaller than the cross section of the total shaft.

In the component shafts, the distance from the center of the component shaft to the shaft wall is less than the corresponding distance in a shaft without the vertical walls. As a result, there is a smaller difference to the rate of descent by coke particles at the center as compared with near the edge of a component shaft. To obtain a still more uniform rate of coke descent, a flow diverting prop is disposed at the bottom of each component shaft substantially at the center, in cross section, of each individual component shaft. The number of radially-extending walls which are uniformly distributed over the cross section of the shaft must be matched to the particular size of the shaft. Preferably, there are three radial walls which extend from a central core and forms three substantially equal component shafts. Each component shaft incorporates such a flow diverting prop.

The volume of the dry coke cooler can be substantially reduced while uniformly cooling coke because of the subdivision to the cooling chamber. The inlet for cooling gases is divided into two partial streams in order to guide the cooling gases in a substantially countercurrent manner through the descending coke.

According to a further feature of the present invention, the cooling gases are supplied to the cooling chamber by two superimposed annular chambers surrounding an outlet cone at the lower part of the shaft. Box-like pipes extend radially from the top annular chamber to a pipe centrally disposed in the cooling chamber and located underneath a masonry core. The central pipe has a downwardly-directed opening which forms charging areas in the descending coke for entry of the cooling gases. The radially-extending walls in the cooling chamber can rest on the box-shaped pipes. The inner wall of the lower annular chamber has peripherally-distributed openings surrounding the cone outlet for introducing additional cooling gases to the coke. Means are incorporated with the pipes for controlling the supply of cooling gas to the annular chambers.

Figure 2:
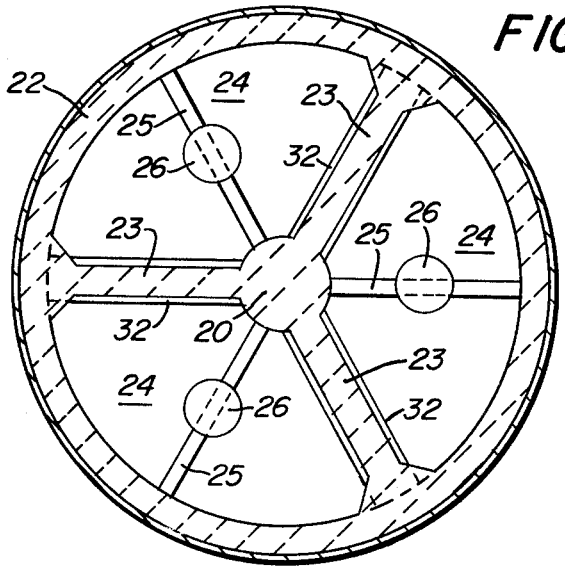

These features and advantages of the present invention as well as others will be more fully understood when the following description of the preferred embodiment is read in light of the accompanying drawings, in which:

FIG. 1 is an elevational view, in section, of a shaft-like cooler for dry-cooling coke; and FIG. 2 is a sectional view taken along line II—II of FIG. 1.

In FIG. 1, reference numeral 10 identifies a top charging opening in a container divided into an antechamber 11 having a wall 21 and a cooling chamber 12 having a wall 22. Adjacent the bottom of the cooling chamber, there is an outlet cone 17 having a coke outlet 30. The coke shaft widens at the transition from the antechamber 11 to the cooling chamber 12 to form charging areas 13 above which there are openings communicating with channels 14 for withdrawing heated cooling gas into an annular collecting pipe 15 having a gas outlet 16.

The outlet cone 17 is surrounded by walls forming annular chambers 18 and 19 which are supplied with cooling gas through lines 27 and 28, respectively. Control means 29, such as valves, are coupled in each of the lines 27 and 28 to control the flow of cooling gas into annular chambers 18 and 19, respectively. Pipes 32 communicate at one end with chamber 18 and extend to a spigot 33 which is open at its bottom where it forms charging areas for the entrance of cooling gas into the descending coke. In a similar manner, cooling gas is introduced into the descending coke through peripherally-distributed openings 31 in the inner wall of the bottom of annular chamber 19.

As shown in FIGS. 1 and 2, vertical walls 23 extend radially from a masonry core 20 and divide the cooling chamber into three component shafts 24. The walls 23 bear on pipes 32 which supply cooling gas and have a box-like shape. Flow diverting props 26 are disposed on rods 25 at the bottom of shafts 24. The props prevent a faster descent of coke at the center of the component shafts 24 than at the sides thereof. The props 26 and the division of cooling chambers into shafts 24 bring about the result that the streams of cooling gas rising in the coke travel approximately equal distances so that the cooling gas rising in channels 14 is made up of component streams of gas at substantially the same temperature. Although the invention has been shown in connection with a certain specific embodiment, it will be readily apparent to those skilled in the art that various changes in form and arrangement of parts may be made to suit requirements without departing from the spirit and scope of the invention.

We claim as our invention:

1. A shaft-like cooler for dry cooling of coke with gases conveyed through the coke, said cooler having the combination of a top antechamber having a coke-charging opening in the top thereof, a cooling chamber below said top antechamber and including an inlet for cooling gases and a coke outlet at the bottom end thereof, said cooling chamber further including three generally vertical walls extending radially to divide said cooling chamber into three uniform shaft components, a central masonry core joining said radial walls together, a flow diverting prop disposed in each of said uniform shaft components, a masonry core centrally disposed in said cooling chamber on said vertical walls, said inlet for cooling gases including a pipe having a downwardly-directed discharge opening underneath said masonry core to form planes in descending coke for cooling gases to enter the coke, and a cylindrical wall including a gas outlet between said antechamber and said cooling chamber.

2. The cooler according to claim 1 further including a conical wall at the bottom of said cooling chamber forming said coke outlet, said inlet for cooling gases including means forming an annular space surrounding said conical wall for supplying cooling gases, and a plurality of duct members for delivering cooling gases from the annular space formed by said means to said pipe.

3. The cooler according to claim 1 wherein said inlet for cooling gases further includes a conical wall at the bottom of said cooling chamber forming said coke outlet, said conical wall defining openings distributed about the periphery thereof for supplying part of said gases for cooling coke.

4. The cooler according to claim 3 further including means forming an annular space surrounding said conical wall for communicating with the openings defined by said conical wall.

5. The cooler according to claim 4 further including means for controlling the flow of gases to the openings defined by said conical wall.

* * * * *